US009487345B1

(12) United States Patent
Vallejo

(10) Patent No.: US 9,487,345 B1
(45) Date of Patent: Nov. 8, 2016

(54) PLANT CARRIER

(71) Applicant: Mauricio Vallejo, Weston, FL (US)

(72) Inventor: Mauricio Vallejo, Weston, FL (US)

(73) Assignee: POTTED VALLEY, LLC, Weston, FL (US)

( * ) Notice: Subject to any disclaimer, the term of this patent is extended or adjusted under 35 U.S.C. 154(b) by 0 days.

(21) Appl. No.: 14/802,892

(22) Filed: Jul. 17, 2015

(51) Int. Cl.
*B65D 85/52* (2006.01)
*B65D 77/04* (2006.01)
*B65D 81/05* (2006.01)

(52) U.S. Cl.
CPC ..... *B65D 85/52* (2013.01); *B65D 77/0433* (2013.01); *B65D 81/05* (2013.01)

(58) Field of Classification Search
USPC ..... 206/423; 47/84
See application file for complete search history.

(56) References Cited

U.S. PATENT DOCUMENTS 3,284,949 A * 11/1966 Park ..... B65D 85/52 206/423
3,852,912 A * 12/1974 Diller ..... A01G 9/028 206/423
4,170,301 A * 10/1979 Jones ..... B65D 85/52 206/423
5,141,149 A * 8/1992 Fulton ..... B65D 5/003 206/423
5,692,612 A * 12/1997 Weder ..... B65D 5/50 206/423
6,250,467 B1 * 6/2001 Weder ..... B65D 81/052 206/423

* cited by examiner

*Primary Examiner* — Jacob K Ackun
(74) *Attorney, Agent, or Firm* — Christopher J. VanDam PA; Chris Vandam

(57) ABSTRACT

A device is shown to transport potted plants through the mail and other common carriers. A tray assembly includes a series of apertures that hold potted plants. A beam holds the plants into the tray assembly. The tray assembly is enclosed inside of a box assembly. The beam is held in place over the pots when tabs are held into slots by the walls of the box assembly. Indents on the corners of the box assembly hold the tray assembly to the bottom of the box assembly.

4 Claims, 3 Drawing Sheets

PLANT CARRIER

BACKGROUND OF THE INVENTION

1. Field of the Invention

The present invention relates to parcel packaging, and more particularly, to a device and method for protecting plants during transport.

2. Description of the Related Art

Several designs for plant transport containers have been designed in the past. None of them, however, includes an inner tray that secures multiple plants relative to the tray with a beam that acts to secure soil into the pots and secures the pots to the tray that is further secured inside a bottom edge of an outer box where the tray is immobile inside the out box when the box is closed.

Applicant believes that the closest reference corresponds to U.S. Pat. No. 4,170,301 issued to Jones. However, it differs from the present invention because Jones does not teach or suggest that a removable beam is used to hold the plants into a tray where that beam is held into the tray when the tray is placed and sealed into a box.

Currently many growers will use special transport systems for local or regional delivery of potted plants. For example, custom racks, crates or containers are utilized along with specialized moving equipment to ship plants. Generally, the movers in this type of system are careful to not invert the plants and pay special care to avoid injuring the delicate living and growing cargo.

Sometimes packages shipped by government or private package delivery services are disturbed, inverted, shaken and banged about. In the past, this has made it impossible to ship by these methods. A plant was unlikely to survive without careful and attentive treatment as provided by a dedicated plant delivery service.

With the present design it has now become feasible to transport live plants in bulk by common carrier. A low cost and robust plant transportation means that can also be used for display purposes upon arrival at its destination is now presented.

Other known products, methods and patents describing related subject matter provide for a number of more or less complicated features that fail to solve the problem in reliable, efficient and economical fashion. None of these things or patents suggest the novel features of the present invention.

SUMMARY OF THE INVENTION

It is one of the main objects of the present invention to provide a plant shipper that efficiently protects plants during the shipping and transport process.

It is another object of this invention to provide a plant shipper that can be used to transport plants while in pots containing a planting medium without displacing the medium while shipping.

It is still another object of the present invention to provide a shipping container for plants that can be used as a convenient display case when the plants arrive at their destination.

Another object of the invention is to provide a plant carrier that can withstand complete inversion during throughout the course of transport thereby protecting the shipped plants.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
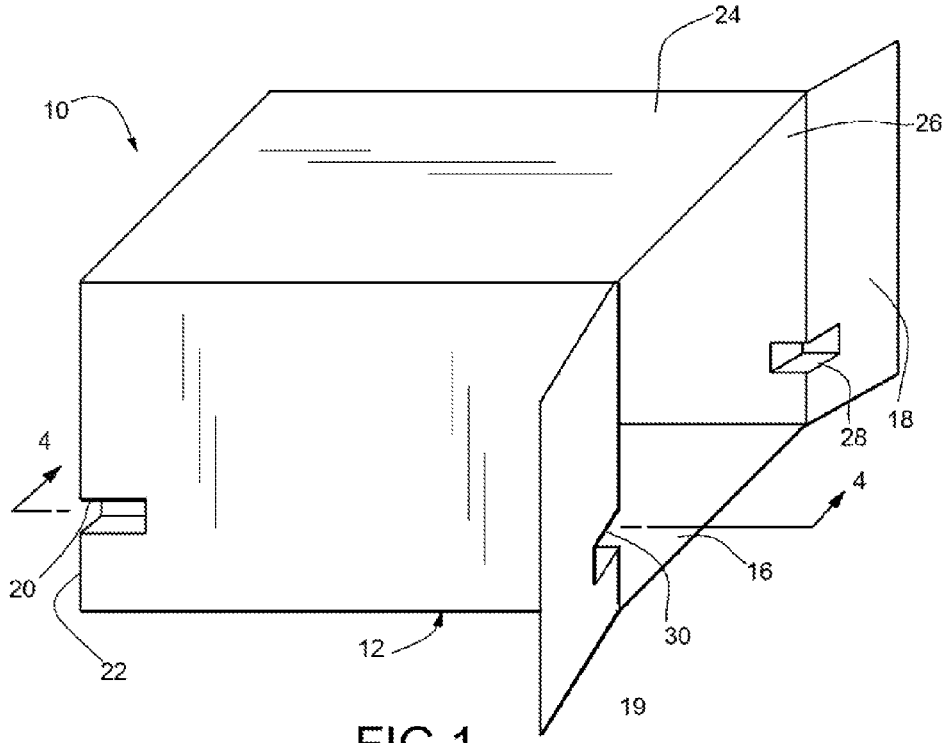
FIG. 1 shows a perspective view of a box assembly.
Figure 2:
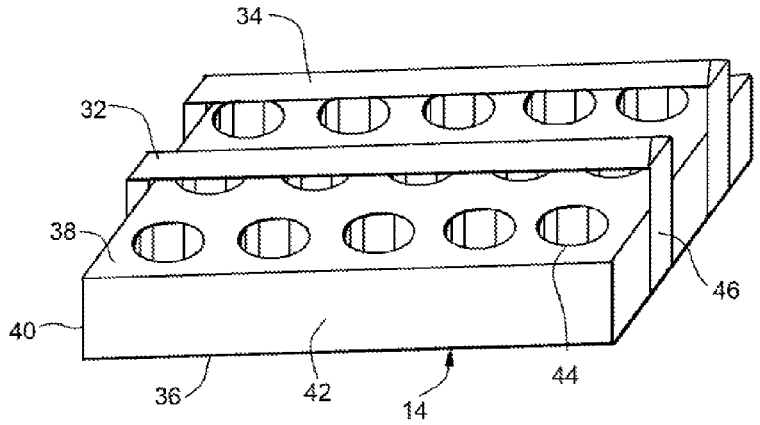
FIG. 2 shows a perspective view of a tray assembly.

Referring now to the drawings, where the present invention is generally referred to with numeral 10, it can be observed that it basically includes a box assembly 12 as shown generally in FIG. 1 and a tray assembly 14 as shown generally in FIG. 2.

A version of the box assembly 12 as seen in FIG. 1 includes, among other features, a bottom 16, a flap 18, a flap 19, an indent 20, a height 22, a top 24, a side 26, an indent 28 and an indent 30.

A version of the tray assembly 14 as seen in FIG. 2 includes, among other features, a beam 32, beam 34, a bottom 36, a top 38, a height 40, a side 42, an aperture 44, a riser 46, a slot 52 and a tab 54. A pot 48, a plant 50, a rim 56 and a tamp 58 are shown as well for context and a preferred method of use.

Referring now specifically to FIG. 1 where a version of the box assembly 12 is shown in isolation from other elements of the device. A preferred version of the design incorporates a six sided box assembly 12 with a top 24 opposite a bottom 16 and a side 26 opposite another side. The rear of the box preferably includes a pair of flaps similar to the flaps 18 and 19 on the front of the box assembly 12.

The box assembly 12 at each of the corners between the sides and front/back has an indent cut from the material of the box. The indents 20, 28, and 30, along with the indent unseen in FIG. 1 are essentially cuts along the sides and back/front so that the corner is inverted as more clearly shown in FIG. 4.

The primary purpose of the indents is to hold the tray assembly 14 against the bottom 16 of the box assembly 12 when the tray assembly 14 is fully inside the box assembly 12 as it would be configured to transport. The indents can be indented during erection of the box assembly 12 prior to insertion of the tray assembly 14 or after the tray assembly 14 has been placed into box assembly 12.

In typical use, the tray assembly 14 includes plants 50 that extend above the top 38 of the tray assembly 14. By holding the tray assembly 14 against the bottom 16 of the box assembly 12 the tops of the plants 50 are prevented from impacting the interior of the box assembly 12 and are therefore protected from damage during a frequently tumultuous experience during shipping.

The height 22 between the bottom of the indent 20 and the bottom 16 should consistent for all of the other indents in the other corners when the tray assembly 14 is essentially box shaped. Generally, the height 22 is about equal to (or slightly greater than) the height 40 of the tray assembly so that there is little movement of the tray assembly 12 when tucked inside the box assembly 12.

It is possible to have a tray assembly that is not uniform in height 40 at each of the corners of the box assembly 12. In that situation the height 40 of any given corner of that version of a tray assembly would preferably be matched to the height 22 of that version of a box assembly so that the tray assembly is held against the bottom of the box assembly for protection of the plants contained inside.

Figure 3:
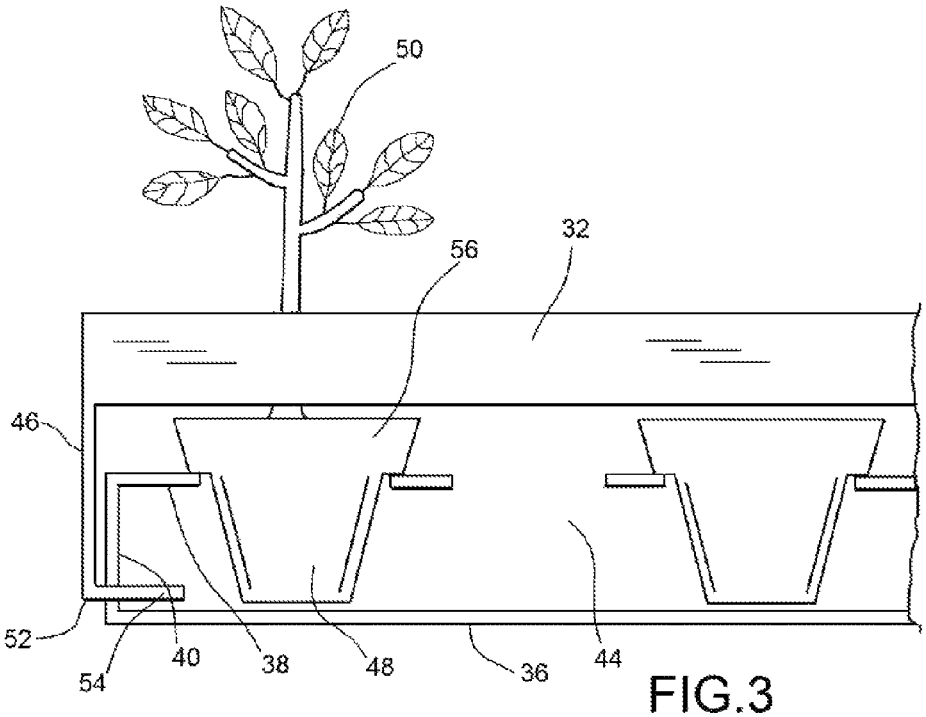
FIG. 3 shows an elevation view cross-section of a tray assembly.
Figure 4:
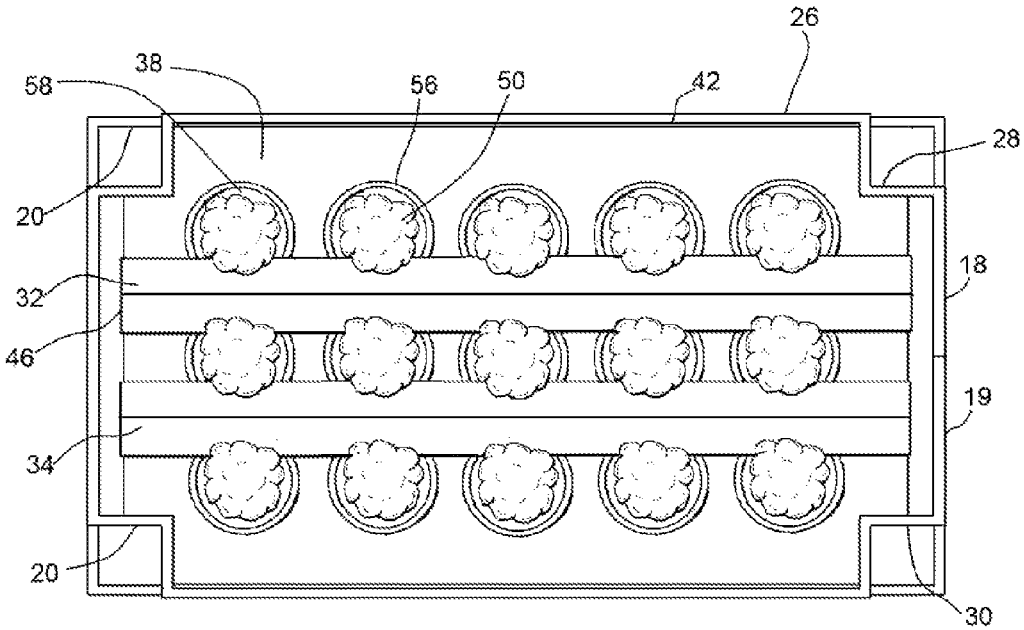
FIG. 4 shows a plan view cross section of a tray assembly inside of a box assembly.

Now referring to FIGS. 2, 3 and 4 where related versions of tray assemblies are shown. The tray assembly 14, in its several iterations, is generally used to hold several potted plants in a fixed position and protect the plants from contact with each other and from the inside of the box assembly 12 into which the tray assembly 14 is placed.

In a version of the tray assembly 14 there is a top 38 surface parallel to a bottom 36 surface bounded by a side 42 on at least two edges. The top 38 has a plurality of apertures 44 that are dimensioned to accept a pot 48. It could also be viable to have a single aperture 44 in the top 38 for single shipping containers.

The apertures 44 may be arranged to maximize the number of apertures that fit into a top 38. It may also be important to space the apertures differently for various types of plants to be transported. For example, a spread out and bushy type plant might need more space to not interfere with adjacent plants than a narrow plant like a cactus or other compact plant.

The height 40 of the tray assembly 14 is dimensioned to correspond to the height 22 of the box assembly 12. Typically the height 40 might be between about an eighth to a half of an inch less than the height 22 so that the tray assembly 14 will fit inside the box assembly 12 and the indents 20, 30, 28 (and other corner indent not visible in figure one) will hold the tray assembly 14 against the bottom 16. In this way the tray assembly 14 is immobilized against the bottom 16 when fully inside the box assembly 12 and the plants are protected above the top 38.

A beam 32 and beam 34 are provided to hold the pot 48 into an aperture 44. The beams 32 and 34 generally do not traverse the center of the pot 48 where the plant 50 stem protrudes. The beams 32 and 34 may touch or nearly touch the top rim 56 of the pot 48. The rim 56 is slightly wider than the dimension across an aperture 44 so that the pot 48 cannot fully pass through the aperture. In some versions of the device the rim 56 rests on the top 38 to support the pot 48. In a related version of the device the pot 48 may simply rest on the bottom 36 and the aperture 44 may be dimensioned correspondingly so that the pot 48 and contained plant 50 cannot shift during transit.

In many cases the tray assembly 14 and box assembly 12 are adapted for a particular style and dimension of pot 48, with or without a rim 56. The beam 32 as seen figure three is materially similar in style to beam 34 as seen in other views. The height of the riser 46 affixed to the beam 32 can affect how tightly the pot 48 is held into the tray assembly 14. Preferably the riser 46 is dimensioned to snugly hold the pot 48 into the aperture 44 of the tray assembly 14.

One effective means to connect the riser 46 and beam 32 combination to the tray assembly 14 is a tab 54 at the lower end of the riser 46 that fits into a slot 52 on the height 40 of the tray assembly 14. This is particularly effective because when the tray assembly 14 is inserted into a box assembly 12 with the tab 54 of the riser 46 inserted into the slot 52 and the box assembly 12 is closed then the tab 54 cannot back out of the slot 52 and the beam 32 is held firmly in place holding down the pot 48. For the same reasons, when packing or unpacking the tray assembly 14 into the box assembly the beam can be readily installed and removed without complication of traditional fastening means.

Figure 5:
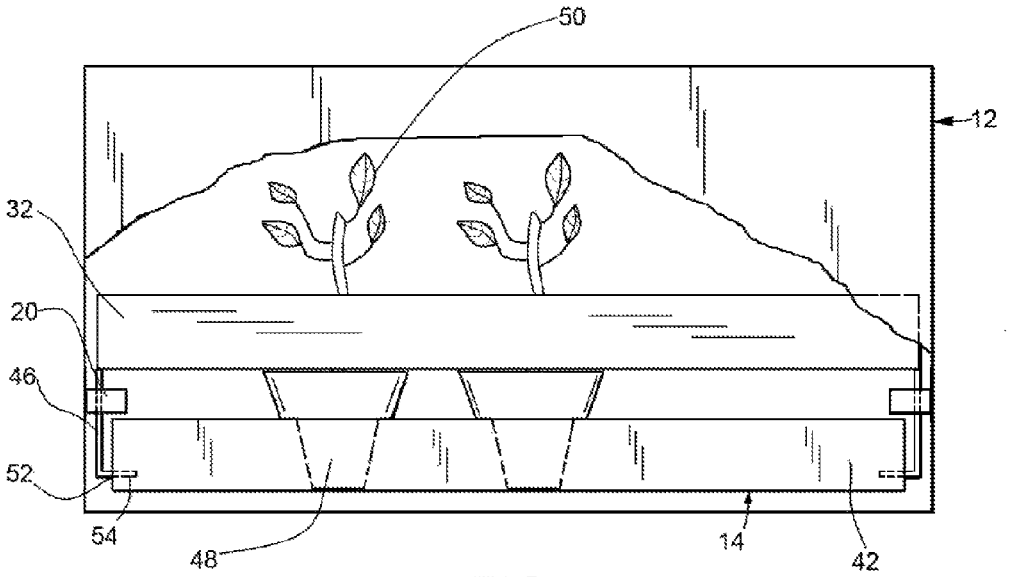
FIG. 5 shows an elevation view cross section of a tray assembly inside of a box assembly.

In typical use the pots 48 are inserted into the apertures 44 in the tray assembly 14 first. Then the beam 32 is placed over the rim 56 of the pot 48. The tabs 54, one on each end of the beam 32, are inserted into slots 52, with also a corresponding slot for the other end of the beam 32. Although figure three shows only a truncated portion of a tray assembly 14 and beam 32, the right is essentially a mirror image of the left side. In other words a riser 46 is on each end of the beam 32 with a corresponding slot 52 on each end of the tray assembly 14. FIG. 5 shows an example of this symmetrical configuration.

In another version of the beam 32 the riser 46 can be affixed to the tray assembly with other attachment means such as tape, glue, staples or other such fastening means. However, the slot 52 and tab 54 method may be more effective because how the box assembly 12 can secure the riser 46 and tab 54 can be installed and removed with ease.

The easy removable tab 54 and slot 52 combination are also an advantage if the device is used as both a transport box and then as a display box. For example, a grower might ship a twelve pack of plants and when received by the retailer, the whole tray assembly 14 with the plants in tact can be used as a retail display after removing the beams 32 and 34 by easily pulling the tab 54 and riser 46 from the slot 52.

In a variant of the device a tamp 58 material can be placed on the top of the soil into which the plant 50 is growing in the pot 48. The tamp 58 can be a thin layer of paper, cardboard, fabric, plastic or other material suitable for holding the soil into the pot 48 if the entire box assembly 12 is inverted or otherwise disturbed during shipping. The tamp 58 may be made of a breathable material and/or a material that allows the passage of water thought it yet prevents soil particles from escaping the pot 48 regardless of the angle of inclination. Soilless mediums or highly rooted plants may not require any tamp 58 at all.

In some applications one, two or more beams may be used effectively. One deciding on the number and size of pots as well as the overall dimensions of the box assembly 12 would easily determine the effective configuration of the number and placement of the beams to ensure that all plants are held into the tray assembly and the plants themselves remain unmolested.

The beams 32 or 34 need not cover the entire top of the pot 48 or cover the entire tamp 58. Generally, if the beam 32 or 34 holds down the pot 48 during the rigors of common carrier transport then the design will be sufficient. The beams 32 or 34 may be triangular in cross section as seen in several of the drawings, but they need not be. The beams 32 or 34 are sufficiently rigid to hold the pots 48 in place. An I-beam or box beam construction of the beams may also be an effective geometry. However, the triangular has an added benefit of ease of manufacture as well as allowing a wide space above the top 38 where bushier plants tend to be a little wider.

I suitable material for construction of any of the parts can be any combination of sheet materials. Cardboard or cardstock may be particularly effective. Corrugated plastic or sheet plastic may also perform well in many applications of the device. If a water absorbing material is used, such as cardboard then a water resistant coating may be advantageous to maintain the integrity of the various components as they come into contact with moisture at any of many points along the path from farm to table.

Figure 6:
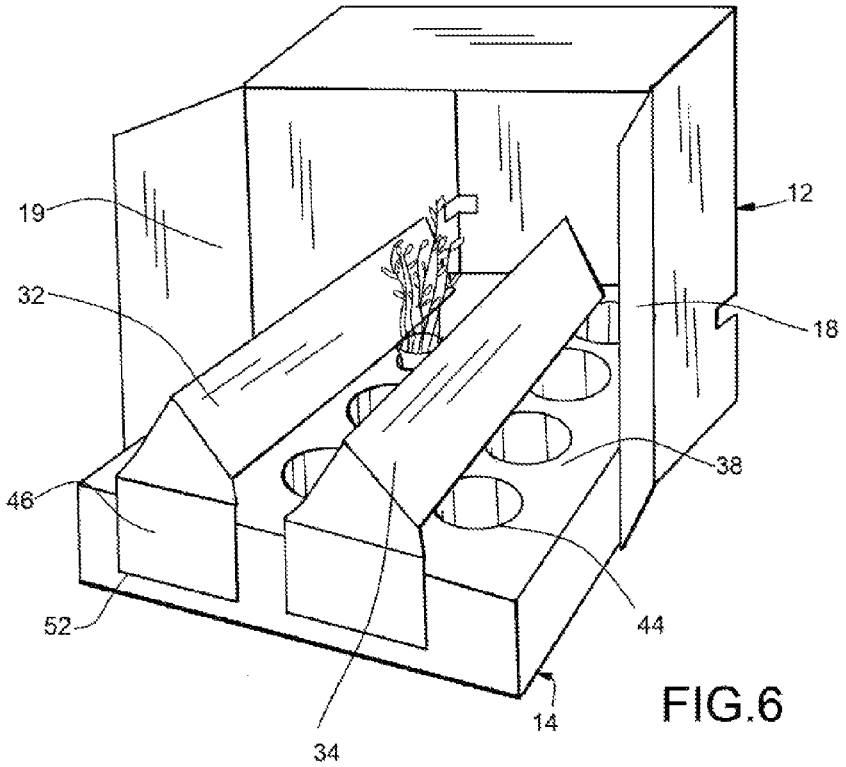
FIG. 6 shows a perspective view of a tray assembly partially inserted into a box assembly.

FIG. 6 shows a tray assembly 14 partially inserted into a box assembly. Note that the tab 54 is inserted into the slot 52 to secure the riser 46 and beam into position. FIG. 5 shows the tray assembly 14 enclosed inside of a box assembly 12. The risers 46 and tabs 54 are secured against the sides of the box assembly 12 so that the plants contained therein are immobilized.

At least one version of the present invention can be fairly described as a plant carrier comprised of a box assembly and a tray assembly. The tray assembly has a top surface and a side extending below the top surface on at least one edge of the tray assembly. The top surface has plural apertures dimensioned to fit around a predetermined pot that pots are placed into for transport or display. A beam attaches to the tray assembly to secure the pot into the aperture by preventing the pot from pulling out of the tray assembly. This is particularly useful during transport of the device. The beam has a tab at a lower end that inserts into a slot on the side of the tray assembly. The beam could also be adhered by means other than a slot and tab combination, for example, tape, glue, hook and loop fastener or other means available. The box assembly has an interior bottom dimension to snugly fit the tray assembly to prevent it from moving around during transport and damaging the plants. At least two corners of the box assembly include an indent that when the tray assembly is fit into the box assembly the indents hold the tray assembly against the interior bottom of the box assembly. The foliage of the plants then is held above the tray in the open interior volume of the box assembly where they remain protected. When the box assembly is closed around the tray assembly the tabs cannot be removed from the slots and the beams are held in place keeping the pots in the respective aperture. An interior volume of the box assembly is sufficient to protect an enclosed plant between the top surface and an upper side of the box assembly.

In a version of the invention the box assembly and tray assembly are constructed of corrugated cardboard. A tamp is optionally included between a top of the pot and the beam to hold the soil into the pot. The tray assembly is optionally coated in a water-resistant material.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A plant carrier comprised of a box assembly and a tray assembly;

the tray assembly has a top surface and a side extending below the top surface;

the top surface has plural apertures dimensioned to fit around a predetermined pot;

a beam attaches to the tray assembly to secure the pot into the aperture;

the beam has a tab at a lower end that inserts into a slot on the side of the tray assembly;

the box assembly has an interior bottom dimension to snugly fit the tray assembly;

at least two corners of the box assembly include an indent;

when the tray assembly is fit into the box assembly the indents hold the tray assembly against the interior bottom of the box assembly;

when the box assembly is closed around the tray assembly the tabs cannot be removed from the slots;

an interior volume of the box assembly is sufficient to protect an enclosed plant between the top surface and an upper side of the box assembly.

2. The plant carrier as disclosed in claim 1 further characterized in that the box assembly and tray assembly are constructed of corrugated cardboard.

3. The plant carrier as disclosed in claim 1 further characterized in that a tamp is included between a top of the pot and the beam.

4. The plant carrier as disclosed, in claim 1 further characterized in that the tray assembly is coated in a water-resistant material.

* * * * *